US008372220B2

(12) United States Patent
Inagaki et al.

(10) Patent No.: US 8,372,220 B2
(45) **Date of Patent: *Feb. 12, 2013**

(54) ALUMINUM ALLOY FORGINGS AND PROCESS FOR PRODUCTION THEREOF

(75) Inventors: Yoshiya Inagaki, Inabe (JP); Manabu Nakai, Kobe (JP); Atsumi Fukuda, Inabe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/527,083

(22) PCT Filed: Mar. 13, 2008

(86) PCT No.: PCT/JP2008/054601

§ 371 (c)(1), (2), (4) Date: Aug. 13, 2009

(87) PCT Pub. No.: WO2008/114680

PCT Pub. Date: Sep. 25, 2008

(65) Prior Publication Data

US 2010/0089503 A1 Apr. 15, 2010

(30) Foreign Application Priority Data

Mar. 14, 2007 (JP) ..... 2007-065882

(51) Int. Cl.
*C22C 21/08* (2006.01)
*C22F 1/05* (2006.01)

(52) U.S. Cl. ..... 148/415; 148/694; 420/544

(58) Field of Classification Search ..... 148/415, 148/417, 694; 420/535, 544
See application file for complete search history.

(56) References Cited

U.S. PATENT DOCUMENTS

| | | | | |
|---|---|---|---|---|
| 3,642,542 | A * | 2/1972 | Sperry et al. | 148/690 |
| 8,152,940 | B2 * | 4/2012 | Nakai et al. | 148/417 |
| 2007/0209739 | A1 * | 9/2007 | Zhao | 148/551 |

FOREIGN PATENT DOCUMENTS

| | | | |
|---|---|---|---|
| JP | 5 247574 | | 9/1993 |
| JP | 6 256880 | | 9/1994 |
| JP | 7 145440 | | 6/1995 |
| JP | 10 317113 | | 12/1998 |
| JP | 2000144296 | A * | 5/2000 |
| JP | 2001 107168 | | 4/2001 |

(Continued)

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

There are provided an aluminum alloy forging having high strength, toughness, and resistance to corrosion in response to the thinning of automotive underbody parts, and a process for production thereof.

The aluminum alloy forging includes an aluminum alloy containing predetermined amounts of Mg, Si, Mn, Fe, Zn, Cu, Cr, Zr, and Ti with the balance being composed of Al and inevitable impurities, and having a hydrogen gas concentration of 0.25 ml/100 g of Al. In the aluminum alloy forging mentioned above, the area ratio of $Mg_2Si$ having a maximum length of 0.1 μm or above is 0.15% or below, the recrystallization ratio of the aluminum alloy is 20% or below, and a size distribution index value defined by V/r of dispersed particles of the aluminum alloy (V: the area ratio [%] of the dispersed particles, and r: the average radius [nm] of the dispersed particles) is 0.20 or above.

9 Claims, 2 Drawing Sheets

FOREIGN PATENT DOCUMENTS

| | | | |
|---|---|---|---|
| JP | 2002 294382 | | 10/2002 |
| JP | 2002 348630 | | 12/2002 |
| JP | 2003-155535 | | 5/2003 |
| JP | 2003155535 A | * | 5/2003 |
| JP | 2004 43907 | | 2/2004 |
| JP | 2004084058 A | * | 3/2004 |
| JP | 2004 292892 | | 10/2004 |
| JP | 2004 292937 | | 10/2004 |
| JP | 3684313 | | 8/2005 |

* cited by examiner

ALUMINUM ALLOY FORGINGS AND PROCESS FOR PRODUCTION THEREOF

TECHNICAL FIELD

The present invention relates to aluminum alloy forgings used for structural materials or structural parts of transportation machines such as automobiles, and particularly for underbody parts.

BACKGROUND ART

Conventionally, in view of global environmental problems due to exhaust gases or the like, an improvement in fuel consumption has been pursued by lightening the body weight of transportation machines such as automobiles. Therefore, in particular, aluminum alloy forgings composed of AA or 6000 series aluminum alloy (Al—Mg—Si series) according to the JIS standard, and the like are used for structural materials or structural parts of transportation machines such as automobiles, and particularly for underbody parts such as upper arms and lower arms. The 6000 series aluminum alloy forgings have high strength, high toughness, and relatively excellent resistance to corrosion. The 6000 series aluminum alloys also have excellent recyclability because of a small number of alloy elements, and easy reusability of scraps as 6000 series aluminum alloy molten raw materials.

Each of the 6000 series aluminum alloy forgings is produced by performing hot forging (die forging) such as mechanical forging or hydraulic forging after homogenizing heat treatment of an aluminum alloy cast material, and then performing so-called tempering treatment including solution, quenching treatment, and artificial aging treatment. As a raw material for forging, besides the cast material mentioned above, an extruded material obtained by extruding a cast material once may also be used.

To improve the strength and toughness of the aluminum alloy forgings, various attempts have been made to improve the microstructures of the forgings. For example, it has been proposed in Patent Documents 1 and 2 that the average grain size of the crystal precipitates (crystallized substances or precipitates) of a 6000 series aluminum alloy forging is decreased to 8 μm or below, and a dendrite secondary arm spacing (DAS) is decreased to 40 μm or below to further increase the strength of the aluminum alloy forging.

In Patent Documents 3 to 5, it has been proposed to further increase the strength and toughness of an aluminum alloy forging by controlling the average grain size, average spacing, or the like of crystal precipitates in the crystal grains of a 6000 series Al alloy forging or on the grain boundaries thereof. The control can increase corrosion resistance even to intergranular corrosion, stress corrosion cracking, or the like. In addition to the control of these crystal precipitates, it has also been proposed to add a transition element having the effect of refining crystal grains, such as Mn, Zr, or Cr, to refine the crystal grains or change them into subcrystal grains, and improve fracture toughness and fatigue properties.

However, the 6000 series Al alloy forging has the tendency to produce coarse crystal grains by recrystallization of a worked structure in a forging step and a solution treatment step. When the coarse crystal grains are produced, higher strength and higher toughness cannot be achieved even by controlling the microstructure, and resistance to corrosion is also decreased. In addition, in these documents, a work temperature in the forging is as relatively low as less than 450° C., and it has been actually difficult to refine the target crystal grains or change them into subcrystal grains by hot forging at such a low temperature.

On the other hand, it has been proposed in Patent Documents 6 to 10 that, in order to suppress the production of coarse crystal grains by recrystallization of the worked structure, a transition element having the effect of refining crystal grains, such as Mn, Zr, or Cr, is added, and then hot forging is started at a relatively high temperature of 450 to 570° C.

Patent Document 1: Japanese Unexamined Patent Application Publication No. Hei 07-145440

Patent Document 2: Japanese Unexamined Patent Application Publication No. Hei 06-256880

Patent Document 3: Japanese Patent Publication No. 3684313

Patent Document 4: Japanese Unexamined Patent Application Publication No. 2001-107168

Patent Document 5: Japanese Unexamined Patent Application Publication No. 2002-294382

Patent Document 6: Japanese Unexamined Patent Application Publication No. Hei 05-247574

Patent Document 7: Japanese Unexamined Patent Application Publication No. 2002-348630

Patent Document 8: Japanese Unexamined Patent Application Publication No. 2004-43907

Patent Document 9: Japanese Unexamined Patent Application Publication No. 2004-292937

Patent Document 10: Japanese Unexamined Patent Application Publication No. 2004-292892

DISCLOSURE OF THE INVENTION

Problems to be Solved by the Invention

In recent years, in order to further lighten the body weight of automobiles, structural materials or structural parts of the bodies, especially automotive underbody parts have been required to be further thinned. Accordingly, aluminum forgings composing the parts and the like are also required to have higher strength, higher toughness, and higher resistance to corrosion in response to the thinning of the parts and the like. However, it cannot be said that the strength, toughness, and resistance to corrosion of conventional aluminum alloy forgings have not been improved in response to the thinning of the materials or the parts.

The present invention has been devised in order to solve such problems, and an object of the present invention is to provide aluminum alloy forgings having high strength, toughness, and resistance to corrosion responsive to the thinning of automotive underbody parts or the like, and a process for production thereof.

Means for Solving the Problems

To solve the problems described above, an aluminum alloy forging according to the present invention includes an aluminum alloy containing, by mass, Mg: 0.6 to 1.0%, Si: 0.8 to 1.4%, Mn: 0.4 to 1.0%, Fe: 0.05 to 0.35%, Zn: 0.1% or below, Cu: 0.2% or below, Cr: 0.35% or below, Zr: 0.25% or below, and Ti: 0.01 to 0.1% with the balance being composed of Al and inevitable impurities, and having a hydrogen gas concentration of 0.25 ml/100 g of Al or below, wherein the area ratio of $Mg_2Si$ having a maximum length of 0.1 μm or above is 0.15% or below, the recrystallization ratio of the aluminum alloy is 20% or below, and a size distribution index value defined by V/r of dispersed particles of the aluminum alloy (V: the area ratio [%] of the dispersed particles, and r: the average radius [nm] of the dispersed particles) is 0.20 or above.

The arrangement described above has the predetermined chemical component composition, the predetermined hydrogen gas concentration, the predetermined area ratio of $Mg_2Si$, the predetermined recrystallization ratio, and the predetermined size distribution index value of the dispersed particles. This improves the strength, toughness, and corrosion resistance of the aluminum alloy forging.

A process for producing an aluminum alloy forging according to the present invention includes a melting step of melting the aluminum alloy having the composition mentioned above into a molten metal, a degassing step of subjecting the molten metal to degassing treatment to adjust the hydrogen gas concentration to 0.25 ml/100 g of Al or below, a casting step of casting the molten metal subjected to the degassing treatment into an ingot, a homogenizing heat treatment step of subjecting the ingot to homogenizing heat treatment in which the ingot is heated up to a holding temperature of 510 to 570° C. at an average heat-up rate more than 20° C./hr and not more than 1000° C./hr, held at the holding temperature for 2 hours or longer, and then cooled such that an average cooling rate during cooling from the holding temperature to at least 350° C. is 110° C./hr or above, a forging step of using the ingot subjected to the homogenizing heat treatment as a forging raw material, and subjecting the forging raw material to hot forging having a starting temperature of 460 to 560° C., and a finishing temperature of 365° C. or above, and a tempering step of performing, after the forging step, T6 or T7 tempering treatment including solution treatment, quenching, and artificial aging treatment.

According to the procedure described above, the aluminum alloy forging is produced from the aluminum alloy having the predetermined chemical component composition under the predetermined degassing treatment condition, the predetermined homogenizing heat treatment condition, and the predetermined hot forging condition. As a result, the area ratio of $Mg_2Si$, the recrystallization ratio, and the size distribution index value of the dispersed particles in the produced aluminum alloy forging fall within the predetermined ranges.

Another process for producing an aluminum alloy forging according to the present invention includes a melting step of melting the aluminum alloy having the composition mentioned above into a molten metal, a degassing step of subjecting the molten metal to degassing treatment to adjust the hydrogen gas concentration to 0.25 ml/100 g of Al or below, a casting step of casting the molten metal subjected to the degassing treatment into an ingot, a homogenizing heat treatment step of subjecting the ingot to homogenizing heat treatment in which the ingot is heated up to a holding temperature of 510 to 570° C. at an average heat-up rate more than 20° C./hr and not more than 1000° C./hr, held at the holding temperature for 2 hours or longer, and then cooled such that an average cooling rate during cooling from the holding temperature to at least 350° C. is 110° C./hr or above, an extrusion step of subjecting the ingot subjected to the homogenizing heat treatment to hot extrusion having a finishing temperature of 365° C. or above into an extruded material, a forging step of using the extruded material as a forging raw material, and subjecting the forging raw material to hot forging having a starting temperature of 460 to 560° C., and a finishing temperature of 365° C. or above, and a tempering step of performing, after the forging step, T6 or T7 tempering treatment including solution treatment, quenching, and artificial aging treatment.

The procedure described above includes the extrusion step, and uses the extruded material as the forging raw material. This further improves the elongation and toughness of the produced aluminum alloy forging.

Effects of the Invention

The aluminum alloy forging according to the present invention has high strength, toughness, and resistance to corrosion responsive to the thinning of automotive underbody parts.

In accordance with the process for producing the aluminum alloy forging according to the present invention, an aluminum alloy forging having high strength, toughness, and resistance to corrosion can be produced.

EXPLANATIONS OF LETTERS AND NUMERALS

Figure 1:
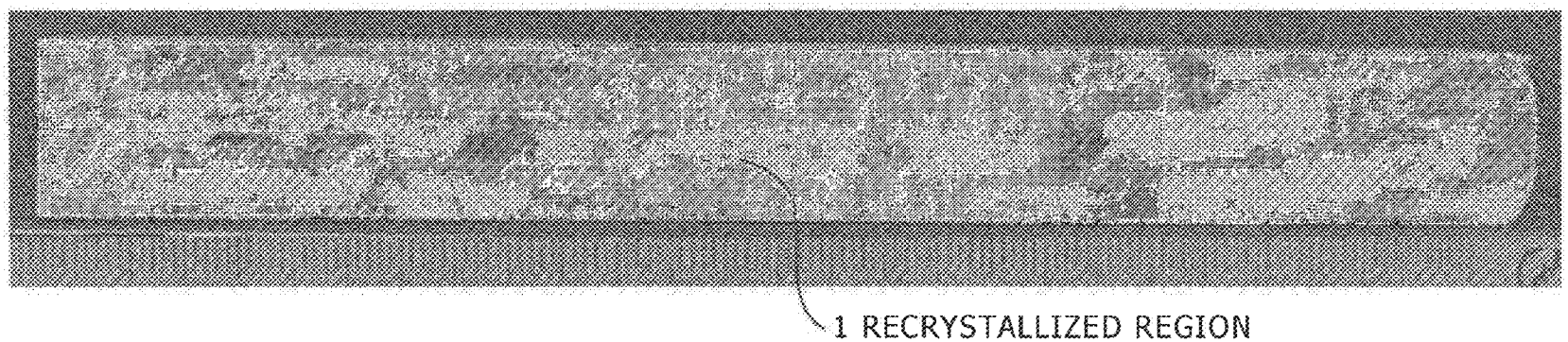
FIG. 1 A cross-sectional photograph showing the state of the metal structure of an aluminum alloy forging according to the present invention.

| | |
|---|---|
| 1 | Recrystallized Region |
| 2 | Dispersed Particles |

BEST MODE FOR CARRYING OUT THE INVENTION

<Aluminum Alloy Forging>

An aluminum alloy forging according to the present invention is described in detail.

To be used for automotive underbody parts such as, e.g., upper arms, or lower arms, the aluminum alloy forging is required to secure high strength, high toughness, and high resistance to corrosion (durability) such as resistance to stress corrosion cracking.

For this reason, the aluminum alloy forging includes an aluminum alloy containing predetermined contents of Mg, Si, Mn, Fe, Zn, Cu, Cr, Zr, and Ti with the balance being composed of Al and inevitable impurities, and having a predetermined hydrogen gas concentration. It is to be noted that other elements are allowed to be contained appropriately within a range which does not inhibit the characteristics of the present invention. In addition, inevitable impurities which are inevitably mixed from molten raw material scraps are also allowed within a range which does not inhibit the characteristics of the present invention.

Hereinbelow, the content of each element in the aluminum alloy, the numerical range of the hydrogen gas concentration, and the critical significance thereof are described.

(Mg: 0.6 to 1.0% by Mass)

Mg is precipitated as a β" phase and a β' phase in crystal grains together with Si by artificial aging treatment, and is an essential element for imparting high strength (yield strength) when the aluminum alloy forging is used for an automotive underbody part or the like. When the content of Mg is less than 0.6% by mass, the amount of age hardening during the artificial aging treatment is decreased. Accordingly, the content of Mg is adjusted to 0.6% by mass or above. More preferably, the content of Mg is 0.62% by mass or above. On the other hand, when the content of Mg exceeds 1.0% by mass, strength (yield strength) is excessively increased to inhibit forging properties. In addition, large amounts of coarse $Mg_2Si$ and elemental Si are easily precipitated during the course of quenching after solution treatment to rather decrease strength, toughness, resistance to corrosion, and the like. Accordingly, the content of Mg is adjusted to 1.0% by mass or below. More preferably, the content of Mg is 0.92% by mass or below.

(Si: 0.8 to 1.4% by Mass)

Si is precipitated as a β" phase and a β' phase in crystal grains together with Mg by the artificial aging treatment, and is an essential element for imparting high strength (yield strength) when the aluminum alloy forging is used for an automotive underbody part or the like. When the content of Si is less than 0.8% by mass, the amount of age hardening during the artificial aging treatment is decreased. Accordingly, the content of Si is adjusted to 0.8% by mass or above. More preferably, the content of Si is 1.0% by mass or above. On the other hand, when the content of Si exceeds 1.4% by mass, strength (yield strength) is excessively increased to inhibit forging properties. In addition, large amounts of coarse $Mg_2Si$ and elemental Si are easily precipitated during the course of the quenching after the solution treatment to rather decrease strength, toughness, resistance to corrosion, and the like. Accordingly, the content of Si is adjusted to 1.4% by mass or below. More preferably, the content of Si is 1.3% by mass or below.

When the ratio of the Si content to the Mg content is increased, crystallized substances are formed to enhance the tendency to degrade toughness and fatigue properties. In addition, potentials on grain boundaries and in the vicinities thereof are decreased relative to those in crystal grains to enhance the tendency to decrease resistance to corrosion.

(Mn: 0.4 to 1.0% by Mass, and Cr: 0.35% by Mass or Below)

Mn and Cr produce intermetallic compounds (dispersed particles) in which Mn, Cr, Si, Al, and a part of Fe are selectively bonded according to the contents thereof primarily during heat-up in homogenizing heat treatment and during the holding thereof. Examples of these dispersed particles are shown by an Al—(Mn, Cr)—Si compound, an Al—(Mn, Fe)—Si compound, and an Al—(Mn, Cr, Fe)—Si compound, the representatives of which include $Mn_3SiAl_{12}$, $(MnFe)_3SiAl_{12}$, $(MnCr)_3SiAl_{12}$, $(MnCrFe)_3SiAl_{12}$, and the like.

Since these dispersed particles of Mn and Cr are extremely fine, and uniformly dispersed at a high density depending on production conditions to have the effect of preventing the migration of grain boundaries, they have a high effect of suppressing recrystallization, preventing coarsening of crystal grains after the recrystallization, and refining the crystal grains. In particular, since a large amount of Mn is solved in a solid state into a matrix, an increase in strength is expected.

When the content of Mn is less than 0.4% by mass, these effects cannot be expected, and crystal grains are coarsened to decrease strength, toughness, and resistance to corrosion. On the other hand, when the content of Mn exceeds 1.0% by mass, and/or the content of Cr exceeds 0.35% by mass, coarse intermetallic compounds and crystallized substances are easily produced during melting and forging to originate fracture, and cause the degradation of toughness and fatigue properties. Therefore, both of Mn and Cr are contained such that the Mn content is in the range of Mn: 0.4 to 1.0% by mass and the Cr content is in the range of Cr: 0.35% by mass or below. To achieve the effects mentioned above, Cr is preferably contained such that the Cr content is 0.001% by mass or above. When the Mn content and the Cr content are close to the respective upper limit values mentioned above, dispersed particles are increased, and crystallized substances are easily formed, which may degrade toughness, fatigue properties, and the like. Accordingly, the more preferred upper limit values of the Mn content and the Cu content are 0.9% by mass and 0.25% by mass, respectively. Additionally, the dispersed particles are likely to contain Mn as a component thereof. Therefore, in order to stably increase the density of the precipitates of the dispersed particles, the lower limit value of the Mn content is more preferably adjusted to 0.5% by mass.

(Fe: 0.05 to 0.35% by Mass)

Fe produces dispersed particles together with Mn and Cr, and has the effect of preventing the migration of grain boundaries after recrystallization, preventing coarsening of crystal grains, and refining the crystal grains. Examples of these dispersed particles are shown by an Al—(Mn, Fe)—Si compound and an Al—(Mn, Cr, Fe)—Si compound, the representatives of which include $(MnFe)_3SiAl_{12}$, $(MnCrFe)_3SiAl_{12}$, and the like. When the content of Fe is less than 0.05% by mass, these effects cannot be expected, and the crystal grains are coarsened to decrease strength, toughness, and resistance to corrosion. Accordingly, the content of Fe is adjusted to 0.05% by mass or above. More preferably, the content of Fe is 0.08% by mass or above. On the other hand, when the content of Fe exceeds 0.35% by mass, A—Fe series coarse crystallized substances are produced. These crystallized substances degrade fracture toughness, fatigue properties, and the like. Accordingly, the content of Fe is adjusted to 0.35% by mass or below. For the same reason as the more preferred upper limit value is provided for Mn, the more preferred upper limit value provided for Fe is 0.30% by mass.

(Zn: 0.1% by Mass or Below)

When the content of Zn exceeds 0.1% by mass, it significantly enhances the susceptibility of the structure of the aluminum alloy forging to stress corrosion cracking or to intergranular corrosion to decrease the corrosion resistance (durability) of the aluminum alloy forging. Accordingly, the Zn content is adjusted to 0.1% by mass or below. More preferably, the Zn content is 0.05% by mass or below.

(Cu: 0.2% by Mass or Below)

Cu has the effect of not only contributing to an improvement in strength by solid solution hardening, but also significantly promoting age hardening of the aluminum forging. In order to achieve the effect, the Cu content is preferably adjusted to 0.001% by mass or above. However, when the Cu content exceeds 0.2% by mass, it significantly enhances the susceptibility of the structure of the aluminum alloy forging to stress corrosion cracking or to intergranular corrosion thereof to decrease the corrosion resistance (durability) of the aluminum alloy forging. Accordingly, the Cu content is adjusted to 0.2% by mass or below. There may be a case where the aluminum alloy forging of the present invention is applied to a member which cannot substantially be subjected to regular maintenance and inspection for a long period under a severe corrosive environment. In such a case, in order to obtain higher resistance to corrosion, the upper limit value of the Cu content is preferably adjusted to 0.1% by mass.

(Zr: 0.25% by Mass or Below)

Like Mn, Cr, and Fe, Zr forms dispersed particles, and effects the suppression of recrystallization and the refinement of crystal grains. Typical examples of the dispersed particles are shown by $ZrAl_3$ and the like. Since Zr series dispersed particles are formed extremely finer at a higher density than Mn series dispersed particles, Cr series dispersed particles, and Fe series dispersed particles, the effect of suppressing recrystallization and refining crystal grains is high. To achieve the effect, the Zr content is preferably adjusted to 0.001% by mass or above.

However, the addition of Zr becomes a factor which rather inhibits the refinement of crystal grains in an ingot depending on casting conditions. In particular, Zr produces a Ti—Zr compound, and becomes a factor which inhibits the effect of refining Ti or Ti—B ingot crystal grains, and coarsening the crystal grains in the ingot. Coarse crystal grains in the ingot remain in substantially the same sizes and shapes at a site in a product where workability during forging is low. As a result, fracture along grain boundaries or the like easily occurs to degrade toughness, fatigue properties, and even resistance to corrosion.

The degree to which the addition of Zr inhibits the effect of refining Ti—B ingot crystal grains is significantly affected by a time period from the introduction of an ingot-crystal-grain refiner containing Zr into a molten metal to the start of casting. As the time period is longer, the refining effect becomes lower, and the crystal grains in the ingot are more coarsened. In the present invention, even in equipment in which the ingot-crystal-grain refiner is introduced immediately before the start of casting, an excessive content of Zr leads to easy production of coarse intermetallic compounds and crystallized substances during melting and casting to originate fracture, and cause the degradation of toughness, fatigue properties, and even resistance to corrosion. Accordingly, the Zr content is adjusted to 0.25% by mass or below. For the same reason as the more preferred upper limit value is provided for Mn, the more preferred upper limit value provided for Zr is 0.18% by mass.

(Ti: 0.01 to 0.1% by Mass)

Ti has the effect of refining the crystal grains in the ingot, and changing the structure of the forging into subcrystal grains. When the content of Ti is less than 0.01% by mass, the effect is not achieved. Accordingly, the content of Ti is adjusted to 0.01% by mass or above. More preferably, the content of Ti is 0.015% by mass or above. However, when the content of Ti exceeds 0.1% by mass, coarse crystallized substances are formed to decrease workability. Therefore, the content of Ti is adjusted to 0.1% by mass or below. More preferably, the content of Ti is 0.65% by mass or below.

(Inevitable Impurities)

Inevitable impurities include the elements described below.

V, Hf, and the like are easily mixed as inevitable impurities, and the effect of refining crystal grains can be expected therefrom as long as the contents thereof are extremely small. However, when the contents thereof are increased, coarse intermetallic compounds are formed to degrade toughness and fatigue properties. Accordingly, the total content of V and Hf is adjusted to be less than 0.2% by mass.

B is also an inevitable impurity but, like Ti, it has the effect of refining the crystal grains in the ingot, and improving workability during extrusion and forging. However, when the content of B exceeds 300 ppm, B also forms coarse crystallized substances to decrease workability. Therefore, an allowable content of B is 300 ppm or below.

(Hydrogen Gas Concentration: 0.25 ml/100 g of Al or Below)

A hydrogen gas is easily mixed as an impurity at the melting of an aluminum alloy. In particular, when the degree of working of a forging is decreased, air bubbles resulting from hydrogen are not pressure-bonded by forging or like working to easily originate fracture, and significantly degrade toughness and fatigue properties. In particular, when an aluminum forging with increased strength is used for an automotive underbody part or the like, the influence of hydrogen is large. Therefore, a hydrogen gas concentration per 100 g of Al is adjusted to 0.25 ml or below.

The aluminum alloy forging also needs to have the area ratio of $Mg_2Si$, the recrystallization ratio, and the size distribution index value of the dispersed particles in predetermined ranges. Hereinbelow, the numerical ranges, and the critical significance thereof are described.

(Area Ratio of $Mg_2Si$: 0.15% by Mass or Below)

In the aluminum alloy forging, the area ratio of $Mg_2Si$ having a maximum length of 0.1 μm or above needs to be 0.15% or below. When the area ratio exceeds 0.15%, it is difficult to improve all of the strength, toughness, and corrosion resistance of the aluminum alloy forging: Here, the area ratio (%) is a representation of the ratio (%) of an area occupied by $Mg_2Si$ to the area of a SEM observation field in a cross section of the aluminum alloy forging. The control of the area ratio of $Mg_2Si$ having a maximum length of 0.1 μm or above is accomplished by controlling the homogenizing heat treatment in the steps of producing the aluminum alloy forging described later, specifically an average heat-up rate to a holding temperature, the holding temperature, and an average cooling rate from the holding temperature to at least 350° C.

(Recrystallization Ratio: 20% or Below)

In the aluminum alloy forging, the recrystallization ratio of an aluminum alloy needs to be 20% or below. When the recrystallization ratio exceeds 20%, it is difficult to improve all of the strength, toughness, and corrosion resistance of the aluminum alloy forging. Here, the recrystallization ratio (%) is a representation of the ratio (%) of an area occupied by a recrystallized region in a cross section of the aluminum alloy forging. In FIG. 1 showing the state of the metal structure of the aluminum alloy forging, the region observed in white is a recrystallized region 1. The control of the recrystallization ratio is accomplished by controlling the homogenizing heat treatment, and forging conditions in the steps of producing the aluminum alloy forging. Specifically, the average heat-up rate to the holding temperature, and the holding temperature in the homogenizing heat treatment are controlled. In addition, a starting temperature and a finishing temperature in a forging step are controlled.

(Size Distribution Index Value of Dispersed Particles: 0.20 or Above)

Figure 2:
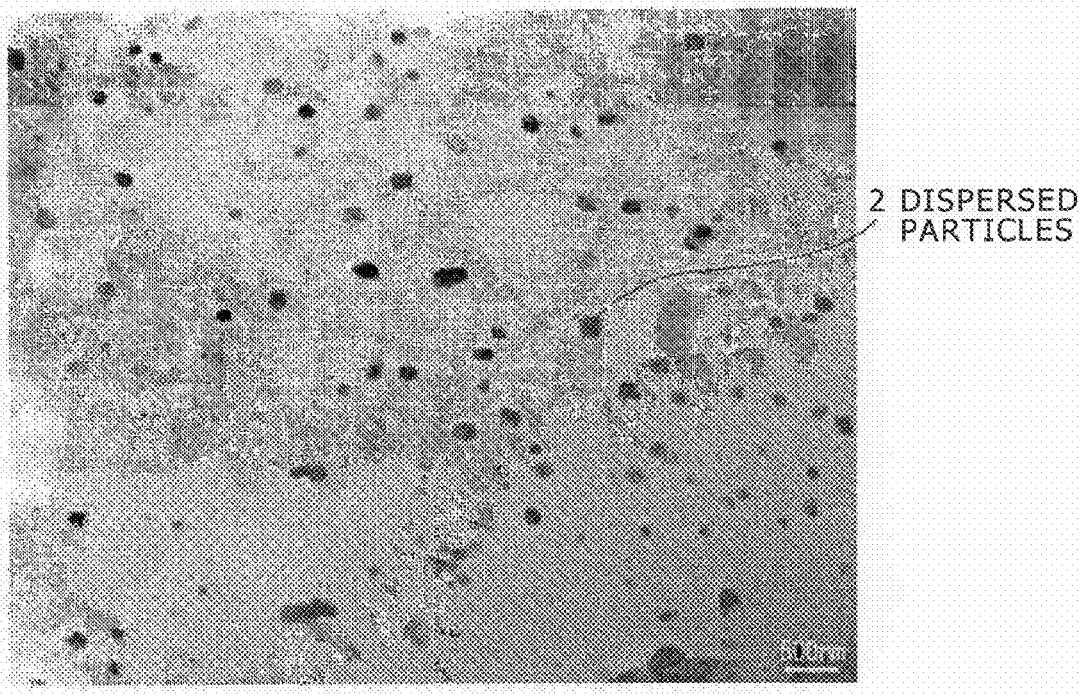
FIG. 2 A TEM photograph of the aluminum alloy forging according to the present invention.

In the aluminum alloy forging, the size distribution index value defined by V/r of the dispersed particles of the aluminum alloy (V: the area ratio [%] of the dispersed particles, and r: the average radius [nm] of the dispersed particles) needs to be 0.20 or above. When the size distribution index value is less than 0.20, it is difficult to improve all of the strength, toughness, and corrosion resistance of the aluminum forging. As described above, the dispersed particles are an Al—(Mn, Fe)—Si compound, an Al—(Mn, Cr)—Si compound, an Al—(Mn, Cr, Fe)—Si compound, an Al—Zr compound, and the like, the representatives of which include $Mn_3SiAl_{12}$, $(MnFe)_3SiAl_{12}$, $(MnCr)_3SiAl_{12}$, $(MnCrFe)_3SiAl_{12}$, $ZrAl_3$, and the like. In FIG. 2 which is a TEM photograph of the aluminum alloy forging, objects observed in the form of black grains are dispersed particles 2. The area ratio (%) of the dispersed particles is a representation of the ratio (%) of a total area occupied by the dispersed particles to a total area of a TEM observation field.

The control of the size distribution index value is accomplished by controlling the homogenizing heat treatment, and the forging conditions in the steps of producing the aluminum alloy forging. Specifically, the average heat-up rate to the holding temperature, and the holding temperature in the homogenizing heat treatment are controlled. In addition, the starting temperature and the finishing temperature in the forging step are controlled.

(Process for Producing Aluminum Alloy Forging)

Next, the process for producing the aluminum alloy forging according to the present invention is described in detail.

The process for producing the aluminum alloy forging includes a melting step, a degassing step, a casting step, a homogenizing heat treatment step, a forging step, and a tempering step. The production steps are conventional production steps but, in order to increase strength, toughness, and resistance to corrosion by using the aluminum alloy forging according to the present invention for an automotive underbody part having a lighter-weight shape, production under specified conditions is needed in each of the production steps described hereinbelow.

(Melting Step)

The melting step is a step of melting the aluminum alloy mentioned above in which the contents of the chemical components are limited to the predetermined ranges.

(Degassing Step)

The degassing step is a step of removing a hydrogen gas (degassing treatment) from the above-mentioned molten metal of the aluminum alloy melted in the melting step, and controlling a hydrogen gas concentration in 100 g of the aluminum alloy to 0.25 ml or below. The removal of the hydrogen gas is performed in a holding furnace for adjusting the components of the molten metal, and removing inclusions by fluxing, chlorine refining, or in-line refining of the molten metal. Preferably, the hydrogen gas is removed by blowing an inert gas of argon or the like into the molten metal using SNIF or porous plugs (Japanese Unexamined Patent Application Publication No. 2002-146447) in an apparatus for removing the hydrogen gas.

Here, the determination of the hydrogen gas concentration is performed by measuring a hydrogen gas concentration in an ingot produced in the casting step described later or in a forging produced in the forging step, which is described later. The hydrogen gas concentration in the ingot can be obtained by, e.g., cutting a sample out of the ingot prior to the homogenizing heat treatment, subjecting the sample to ultrasonic cleaning using alcohol and acetone, and measuring the hydrogen gas concentration in the sample by, e.g., the inert gas flow fusion-thermal conductivity method (LIS A06-1993). On the other hand, the hydrogen gas concentration in the forging can be obtained by, e.g., cutting a sample out of the forging, immersing the sample in a NaOH solution, removing an oxide coating on the surface thereof with a nitric acid, subjecting the sample to ultrasonic cleaning using alcohol and acetone, and measuring the hydrogen gas concentration in the sample by the vacuum heating extraction volumetric method (LIS A06-1993).

(Casting Step)

The casting step is a step of casting the above-mentioned molten metal of the aluminum alloy adjusted to contain the chemical components within predetermined ranges, and subjected to the degassing treatment into an ingot. As a casting method, a typical melting/casting method such as a continuous casting/rolling method, a semi-continuous casting method (DC casting method), or a hot-top casting method is selected appropriately.

However, it is desirable that, when the above-mentioned molten metal of the aluminum alloy is cast, an average cooling rate is adjusted to 100° C./s or above, and a dendrite secondary arm spacing (DAS) is decreased to 20 μm or below. When the average cooling rate during the casting is less than 100° C./s, coarse Al—Fe—Si crystallized substances remain in the aluminum alloy forging to originate fracture so that toughness and fatigue properties, in particular, are likely to be decreased.

(Homogenizing Heat Treatment)

The homogenizing heat treatment step is a step of subjecting the ingot mentioned above to predetermined homogenizing heat treatment. It is necessary to perform homogenizing heat treatment in which the ingot is heated up to a holding temperature of 510 to 570° C. at an average heat-up rate more than 20° C./hr and not more than 1000° C./hr, held at the above-mentioned holding temperature for 2 hours or longer, and then cooled such that an average cooling rate during cooling from the holding temperature to at least 350° C. is 110° C./hr or above. By performing such homogenizing heat treatment, the area ratio of $Mg_2Si$, the recrystallization ratio, and the size distribution index value of the dispersed particles in a cross section of the aluminum alloy forging can be adjusted to fall within the predetermined ranges. The cooling is performed to the starting temperature of the forging step described later, or to a temperature (e.g., a room temperature) lower than the starting temperature.

When the average heat-up rate during the homogenizing heat treatment is 20° C./hr or below, the coarsening of $Mg_2Si$ is promoted so that, in the subsequent solution treatment, the solution treatment under the conditions (temperature and time) of industrial solution treatment is insufficient, and the area ratio of $Mg_2Si$ in a cross section of the aluminum alloy forging exceeds 0.15%. As a result, when the aluminum alloy forging is used for an automotive underbody part or the like, it is difficult to improve all of the strength, corrosion resistance, and toughness thereof. It is also difficult to improve the fatigue properties.

When the average heat-up rate exceeds 1000° C./hr, re-solution of $Mg_2S$ in a solid state is likely to be promoted, but dispersed particles are coarsely and roughly formed, and the size distribution index value (V/r) of the dispersed particles becomes less than 0.20 to inhibit the suppression of recrystallization and refinement of crystal grains due to high-density fine dispersion. Even when the finishing temperature of the forging step (hot forging) described later is 365° C. or above, recrystallization and grain growth occur at the forging end time or during the subsequent solution treatment. Therefore, the recrystallization ratio in a cross section of the aluminum alloy forging cannot be adjusted to 20% or below to decrease the strength of the aluminum alloy forging. As a result, when the aluminum alloy forging is used for an automotive underbody part or the like, it is difficult to improve all of the strength, corrosion resistance, and toughness thereof. It is also difficult to improve the fatigue properties.

When the holding temperature during the homogenizing heat treatment is less than 510° C., the homogenizing heat treatment temperature is excessively low, and re-solution of $Mg_2Si$ in a solid state is insufficient so that coarse $Mg_2Si$ remains in the aluminum alloy forging, and the area ratio of $Mg_2Si$ in a cross section of the aluminum alloy forging exceeds 0.15%. As a result, when the aluminum alloy forging is used for an automotive underbody part or the like, it is difficult to improve all of the strength, corrosion resistance, and toughness thereof. It is also difficult to improve the fatigue properties.

When the holding temperature exceeds 570° C., re-solution of $Mg_2Si$ in a solid state is likely to be promoted, but the dispersed particles are coarsened, and the number thereof is decreased so that the size distribution index value (V/r) of the dispersed particles becomes less than 0.20 to inhibit the suppression of recrystallization and refinement of crystal grains due to high-density fine dispersion. Even when the finishing temperature of the hot forging is 365° C. or above, recrystallization and grain growth occur at the forging end time or during the subsequent solution treatment. Therefore, the recrystallization ratio in a cross section of the aluminum alloy forging cannot be adjusted to 20% or below to decrease the strength of the aluminum alloy forging. As a result, when the aluminum alloy forging is used for an automotive underbody part or the like, it is difficult to improve all of the strength, corrosion resistance, and toughness thereof. It is also difficult to improve the fatigue properties.

On the other hand, when the holding time at a holding temperature of 510 to 570° C. is less than 2 hours, the holding time is insufficient, and re-solution of $Mg_2Si$ in a solid state is insufficient so that coarse $Mg_2Si$ remains in the aluminum forging, and the area ratio of $Mg_2Si$ in a cross section of the aluminum forging exceeds 0.15%. As a result, when the aluminum alloy forging is used for an automotive underbody part or the like, it is difficult to improve all of the strength, corrosion resistance, and toughness thereof.

When the average cooling rate from a holding temperature of 510 to 570° C. to 350° C. is less than 110° C./hr, the coarsening of $Mg_2Si$ is promoted so that, in the subsequent solution treatment, the solution treatment under the conditions (temperature and time) of industrial solution treatment is insufficient, and the area ratio of $Mg_2Si$ in a cross section of the aluminum alloy forging exceeds 0.15%. As a result, when the aluminum alloy forging is used for an automotive underbody part or the like, it is difficult to improve all of the strength, corrosion resistance, and toughness thereof. It is also difficult to improve the fatigue properties.

(Forging Step)

The forging step is a step of using the above-mentioned ingot subjected to the homogenizing heat treatment as a forging raw material, and performing predetermined hot forging by forging using a mechanical press or by forging using an oil hydraulic press with respect to the forging raw material cooled down to the hot forging starting temperature or to the forging raw material cooled down to a temperature (e.g., a room temperature) lower than the hot forging starting temperature, and then re-heated. By the hot forging, the forging raw material may also be worked into the shape of a final product (near-net-shape) such as an automotive underbody part.

It is necessary to perform the hot forging under conditions such that the starting temperature is 460 to 560° C., and the finishing temperature is 365° C. or above. By performing the hot forging under such conditions, the recrystallization ratio in a cross section of the aluminum alloy forging, and the size distribution index value of the dispersed particles can be adjusted to fall within the predetermined ranges. The hot forging may also be performed a plurality of times in succession (e.g., pre-rough forging, middle forging, finishing forging, and the like) as long as the starting temperature and the finishing temperature are not less than these temperatures. In this case, the starting temperature of the initial forging corresponds to the starting temperature of the hot forging, and the finishing temperature of the final forging corresponds to the finishing temperature of the hot forging. After the forging is ended, it is also possible to perform reheating, and the hot forging again.

When the starting temperature in the hot forging is less than 460° C., and/or the finishing temperature therein is less than 365° C., recrystallization and grain growth occur at the forging end time or during the subsequent solution treatment. Therefore, the recrystallization ratio in a cross section of the aluminum alloy forging cannot be adjusted to 20% or below, and the size distribution index value of the dispersed particles cannot be adjusted to 0.20 or above. As a result, when the aluminum alloy forging is used for an automotive underbody part or the like, it is difficult to improve all of the strength, corrosion resistance, and toughness thereof. It is also difficult to improve the fatigue properties. On the other hand, when the starting time exceeds 560° C., workability is decreased to cause cracking or the like during the forging.

(Tempering Step)

The tempering step is a step of performing, after the forging step described above, T6 or T7 tempering treatment including solution treatment, quenching, and artificial aging treatment. By performing such tempering treatment, the aluminum alloy forging is allowed to have strength, corrosion resistance, and toughness necessary for an automotive underbody part or the like. T6 is tempering treatment in which, after the solution treatment and the quenching, the artificial aging treatment for obtaining the maximum strength is performed. T7 is tempering treatment in which, after the solution treatment and the quenching, excessive artificial aging treatment (over-aging treatment) surpassing the conditions of the artificial aging treatment for obtaining the maximum strength is performed.

Unlike in the T6 tempering treatment, that is, the artificial aging treatment after the solution treatment and the quenching, a T7 tempering material is subjected to the over-aging treatment so that the ratio of a β phase precipitated on grain boundaries is high. The β phase is less likely to be eluted under a corrosive environment so that, compared with a T6 tempering material, the T7 tempering material decreases susceptibility to intergranular corrosion, and increases resistance to stress corrosion cracking. Accordingly, by using the aluminum alloy forging as the T7 tempering material, yield strength is slightly decreased, but resistance to corrosion is increased compared with that in another tempering treatment.

Preferably, the solution treatment is held in the temperature range of 530 to 570° C. for 20 minutes to 20 hours. When the solution treatment temperature is excessively low, or the time thereof is excessively short, the solution is insufficient, and the solid solution of $Mg_2Si$ is insufficient so that the strength is likely to be decreased. On the other hand, when the solution treatment temperature is excessively high, or the time thereof is excessively long, localized melting, and coarsening of crystal grains are likely to occur. When heating is performed up to the solution treatment temperature, in order to prevent the coarsening of dispersed particles, and ensure the effect thereof, the average heat-up rate is preferably increased to 100° C./s or above.

The quenching treatment after the solution treatment described above is preferably performed by cooling into water or warm water. During the quenching treatment, an average cooling rate of 100° C./s or above is preferably ensured. When the average cooling rate during the quenching treatment is decreased, $Mg_2Si$, elemental Si, and the like are precipitated on grain boundaries, and intergranular fracture is likely to occur in the aluminum alloy forging after the artificial aging treatment so that toughness and fatigue properties are susceptible to degradation. In addition, during the course of cooling, $Mg_2Si$ as stable phase, elemental Si, and the like are formed even in the grains, and the amount of the β" phase and the β' phase precipitated during the artificial aging treatment is decreased so that the strength of the aluminum alloy forging is likely to be decreased.

However, when the average cooling rate is increased, the amount of quenching strain is increased to newly cause the need for a correction step after the quenching, and the problem of an increased number of steps due to the correction step. In addition, residual stress is also increased to newly cause a problem of lower size and shape precision of a product. In view of this, in order to shorten the step of producing the aluminum alloy forging, and reduce cost, warm-water quenching at 40 to 70° C. which reduces the quenching strain is preferable. When the warm-water quenching temperature is less than 40° C., the quenching strain is increased. When the warm-water quenching temperature exceeds 70° C., the average cooling rate is excessively decreased so that the toughness, fatigue properties, and strength of the aluminum alloy forging are likely to be decreased.

For the solution treatment and the artificial aging treatment after the quenching, conditions under which the aluminum alloy forging becomes the T6 or T7 tempering material are selected appropriately from within the temperature range of 160 to 200° C. and from within the range of the holding time of 20 minutes to 20 hours.

For the homogenizing heat treatment and the solution treatment each described above, an air furnace, an induction heating furnace, a niter furnace, or the like is used appropriately. For the artificial aging treatment, the air furnace, the induction heating furnace, an oil bath, or the like is used appropriately.

In the process for producing the aluminum alloy forging according to the present invention, mechanical working, surface treatment, or the like which is necessary for an automotive underbody part or the like may be performed appropriately before or after the tempering treatment described above.

Another process for producing the aluminum alloy forging according to the present invention will be described.

The process for producing the aluminum alloy forging includes a melting step, a degassing step, a casting step, a homogenizing heat treatment step, an extrusion step, a forging step, and a tempering step. The melting step, the degassing step, the casting step, the homogenizing heat treatment step, the forging step, and the tempering step are the same as in the production method described above so that the description thereof is omitted. In the forging step, an extruded material is used as the forging raw material. In the case of using the extruded material as the forging raw material, crystallized substances are refined during the extrusion so that the average cooling rate in the forging step is sufficient as long as it is 1° C./s or above. Hereinbelow, the extrusion step is described.

(Extrusion Step)

The extrusion step is a step of performing predetermined extrusion by extrusion using a press or the like with respect to the ingot subjected to the homogenizing heat treatment, and cooled down to the hot extrusion starting temperature (preferably 460° C. or above), or to the ingot subjected to the homogenizing heat treatment, cooled down to a temperature (e.g., a room temperature) lower than the hot extrusion starting temperature, and then re-heated.

Hot extrusion needs to be performed under a condition such that the finishing temperature is 365° C. or above. By performing hot extrusion under such a condition, the recrystallization ratio in a cross section of the extruded material can be adjusted to fall within the predetermined range in the same manner as in the hot forging. When the finishing temperature in the hot extrusion is less than 365° C., recrystallization and grain growth occur at the extrusion end time. Therefore, recrystallization is likely to occur during the subsequent hot forging, and the recrystallization ratio in a cross section of a final product (aluminum alloy forging) cannot be adjusted to 20% or below. As a result, when the aluminum alloy forging is used for an automotive underbody part or the like, it is difficult to improve all of the strength, corrosion resistance, and toughness thereof. It is also difficult to improve the fatigue properties.

EXAMPLES

Hereinbelow, the present invention is described more specifically by showing examples. However, the present invention is not primarily limited by the following examples, and can also be practiced by making appropriate changes without departing from the scope of claims.

Aluminum alloys having the chemical component compositions of the alloy numbers 1 to 15, and 17 to 24 shown in Table 1 were melted, subjected to degassing treatment, and cast so that ingots (with the ingot numbers A to Z, and Z2 to Z9) each having a diameter of 85 mm were cast by a semi-continuous casting method (in which an average cooling rate during casting was 150° C./s). On the other hand, an aluminum alloy having the chemical component composition of the alloy number 16 was melted, subjected to degassing treatment, and cast so that an ingot (with the ingot number Z1) having a diameter of 400 mm was cast by the semi-continuous casting method (in which an average cooling rate during casting was 2° C./s). The aluminum alloys (with the alloy numbers 1 to 20) shown in Table 1 contained V, Hf, and B as inevitable impurities, and the total content of V and Hf was less than 0.2% by mass, and the content of B was 300 ppm or below. The hydrogen gas concentrations of the ingots (with the ingot numbers A to Z, and Z1 to Z9) were measured by the inert gas flow fusion-thermal conductivity method (LIS A06-1993), and as shown in Table 1.

TABLE 1

| Ingot | Alloy | Chemical Component Composition (% by Mass) | | | | | | | | | Hydrogen Gas Concentrateion |
|---|---|---|---|---|---|---|---|---|---|---|---|
| No. | No. | Mg | Si | Mn | Fe | Zn | Cu | Cr | Zr | Ti | (ml/100 gAl) |
| A | 1 | 0.80 | 1.15 | 0.80 | 0.20 | Less than 0.01 | 0.05 | 0.17 | 0.01 | 0.02 | 0.23 |
| B | 2 | 0.80 | 1.15 | 0.80 | 0.20 | Less than 0.01 | 0.05 | 0.17 | 0.01 | 0.02 | 0.19 |
| C | 3 | 0.80 | 1.15 | 0.60 | 0.20 | Less than 0.01 | 0.05 | 0.17 | 0.01 | 0.02 | 0.20 |
| D | 4 | 0.80 | 1.15 | 0.40 | 0.20 | Less than 0.01 | 0.05 | 0.17 | 0.01 | 0.02 | 0.22 |
| E | 5 | 0.80 | 1.00 | 0.60 | 0.20 | Less than 0.01 | 0.05 | 0.17 | 0.01 | 0.02 | 0.21 |
| F | 6 | 0.80 | 1.00 | 0.60 | 0.20 | Less than 0.01 | 0.05 | 0.17 | 0.01 | 0.02 | 0.19 |
| G | 7 | 0.65 | 1.15 | 0.60 | 0.20 | Less than 0.01 | 0.05 | 0.17 | 0.01 | 0.02 | 0.22 |
| H | 8 | 0.80 | 1.15 | 0.60 | 0.20 | Less than 0.01 | Less than 0.01 | 0.17 | 0.01 | 0.02 | 0.18 |
| I | 9 | 0.80 | 1.15 | 0.80 | 0.20 | Less than 0.01 | 0.05 | 0.25 | 0.10 | 0.02 | 0.20 |
| J | 10 | 0.75 | 1.15 | 0.90 | 0.20 | Less than 0.01 | 0.05 | 0.17 | 0.01 | 0.02 | 0.21 |
| K | 1 | 0.80 | 1.15 | 0.80 | 0.20 | Less than 0.01 | 0.05 | 0.17 | 0.01 | 0.02 | 0.20 |
| L | 1 | 0.80 | 1.15 | 0.80 | 0.20 | Less than 0.01 | 0.05 | 0.17 | 0.01 | 0.02 | 0.20 |
| M | 1 | 0.80 | 1.15 | 0.80 | 0.20 | Less than 0.01 | 0.05 | 0.17 | 0.01 | 0.02 | 0.20 |
| N | 1 | 0.80 | 1.15 | 0.80 | 0.20 | Less than 0.01 | 0.05 | 0.17 | 0.01 | 0.02 | 0.20 |
| O | 1 | 0.80 | 1.15 | 0.80 | 0.20 | Less than 0.01 | 0.05 | 0.17 | 0.01 | 0.02 | 0.23 |

TABLE 1-continued

| Ingot No. | Alloy No. | Chemical Component Composition (% by Mass) Mg | Si | Mn | Fe | Zn | Cu | Cr | Zr | Ti | Hydrogen Gas Concentrateion (ml/100 gAl) |
|---|---|---|---|---|---|---|---|---|---|---|---|
| P | 1 | 0.80 | 1.15 | 0.80 | 0.20 | Less than 0.01 | 0.05 | 0.17 | 0.01 | 0.02 | 0.23 |
| Q | 1 | 0.80 | 1.15 | 0.80 | 0.20 | Less than 0.01 | 0.05 | 0.17 | 0.01 | 0.02 | 0.23 |
| R | 1 | 0.80 | 1.15 | 0.80 | 0.20 | Less than 0.01 | 0.05 | 0.17 | 0.01 | 0.02 | 0.23 |
| S | 1 | 0.80 | 1.15 | 0.80 | 0.20 | Less than 0.01 | 0.05 | 0.17 | 0.01 | 0.02 | 0.23 |
| T | 1 | 0.80 | 1.15 | 0.80 | 0.20 | Less than 0.01 | 0.05 | 0.17 | 0.01 | 0.02 | 0.23 |
| U | 1 | 0.80 | 1.15 | 0.80 | 0.20 | Less than 0.01 | 0.05 | 0.17 | 0.01 | 0.02 | 0.23 |
| V | 11 | 0.80 | 1.15 | 0.30 | Less than 0.01 | Less than 0.01 | 0.05 | 0.17 | 0.05 | 0.02 | 0.20 |
| W | 12 | 0.50 | 1.45 | 0.80 | 0.20 | Less than 0.01 | 0.01 | 0.17 | 0.05 | 0.02 | 0.18 |
| X | 13 | 1.00 | 1.15 | 1.10 | 0.20 | Less than 0.01 | 0.25 | 0.17 | 0.01 | 0.02 | 0.09 |
| Y | 14 | 1.10 | 0.60 | 0.80 | 0.40 | Less than 0.01 | 0.01 | 0.40 | 0.26 | 0.02 | 0.15 |
| Z | 15 | 0.90 | 1.20 | 0.80 | 0.20 | 0.12 | 0.10 | 0.30 | 0.20 | 0.04 | 0.30 |
| Z1 | 16 | 0.80 | 1.15 | 0.70 | 0.20 | Less than 0.01 | 0.05 | 0.16 | 0.01 | 0.02 | 0.22 |
| Z2 | 17 | 1.20 | 1.20 | 0.80 | 0.20 | Less than 0.01 | 0.05 | 0.17 | 0.05 | 0.02 | 0.20 |
| Z3 | 18 | 0.90 | 1.60 | 0.80 | 0.20 | Less than 0.01 | 0.05 | 0.17 | 0.05 | 0.02 | 0.22 |
| Z4 | 19 | 0.80 | 1.20 | 1.20 | 0.20 | Less than 0.01 | 0.05 | 0.17 | 0.05 | 0.02 | 0.22 |
| Z5 | 20 | 0.80 | 1.20 | 0.80 | 0.60 | Less than 0.01 | 0.05 | 0.17 | 0.05 | 0.02 | 0.18 |
| Z6 | 21 | 0.95 | 1.30 | 0.80 | 0.20 | Less than 0.01 | 0.40 | 0.17 | 0.05 | 0.02 | 0.25 |
| Z7 | 22 | 0.80 | 1.20 | 0.80 | 0.20 | Less than 0.01 | 0.05 | 0.50 | 0.05 | 0.02 | 0.20 |
| Z8 | 23 | 0.80 | 1.20 | 0.80 | 0.20 | Less than 0.01 | 0.05 | 0.17 | 0.35 | 0.02 | 0.22 |
| Z9 | 24 | 0.80 | 1.20 | 0.80 | 0.20 | Less than 0.01 | 0.05 | 0.17 | 0.05 | 0.20 | 0.22 |

Next, the outer surfaces of the ingots (with the ingot numbers A to Z, and Z2 to Z9) mentioned above were each faced by a thickness of 5 mm, cut to a length of 200 mm, and then subjected to homogenizing heat treatment and hot forging using a mechanical press under the individual conditions shown in Table 2 (the heat-up rates and cooling rates of Table 2 are average heat-up rates and average cooling rates) to produce plate-like specimens (Examples 1 to 14, and Comparative Examples 1 to 12, and 14 to 21). On the other hand, the outer surface of the ingot (with the ingot number Z1) was faced by a thickness of 5 mm mentioned above, cut to a length of 600 mm, subjected to homogenizing heat treatment, extruded with an extrusion press to a diameter of 75 mm, and then subjected to hot forging using a mechanical press under the individual conditions shown in Table 2 to produce plate-like specimens (Example 15, and Comparative Example 13) in the same manner as described above.

In the hot forging, each of the ingots or each of extruded materials was heated from a room temperature up to a forging starting temperature plus 20° C. in about 1 hour, and immediately unloaded from a furnace. After the forging starting temperature was checked, the ingots or the extruded materials were radially forged into the plate-like specimens. Forging was performed three times in succession without intermediate reheating, and the plate-like specimens each having a thickness of 16 mm were produced by the third-time forging. After the forging was ended, specimen temperatures (forging finishing temperatures) were immediately measured, and then the specimens were each allowed to be cooled to a room temperature.

Next, the plate-like specimens (Examples 1 to 15, and Comparative Examples 1 to 21) were each subjected to the following T6 tempering treatment. Since forging cracking occurred in Comparative Example 7, the T6 tempering treatment was not performed.

(Conditions of T6 Tempering Treatment)

In solution treatment, the plate-like specimens were each heated up from a room temperature to 555° C. in about 1 hour, held for 3 hours, and then subjected to quenching in warm water at 40° C. After the quenching, the plate-like specimens were each allowed to stay immersed in the warm water for 10 minutes, and then immediately subjected to artificial aging treatment. The conditions of the artificial aging treatment were 180° C. and 5 hours.

For each of the plate-like specimens (subjected to the T6 treatment) of Examples 1 to 15, and Comparative Examples 1 to 21, the area ratio of $Mg_2Si$, the recrystallization ratio of the aluminum alloy, and the size distribution index value (expressed as V/r in Table 2) of the dispersed particles of the aluminum alloy were measured by the following measurement method. The result of the measurement is shown in Table 2. Since forging cracking occurred in Comparative Example 7, the area ratio, the recrystallization ratio, and the size distribution index value were not measured.

(Area Ratio of $Mg_2Si$)

Samples were collected from 5 sites of each of the plate-like specimens, and the cross sections (bidirectional: in the direction of a grain flow and in the direction perpendicular to the grain flow) thereof were each polished till reaching a specular state. Then, $Mg_2Si$ in the total of 10 cross sections of 2 cross sections at 5 sites was observed using a SEM (scanning electron microscope of a magnification of ×500), the area ratio of $Mg_2Si$ having a maximum length of 0.1 μm or above was calculated by image analysis, and an average value in the 10 cross sections was calculated. The area ratio is a representation of the ratio (%) of an area occupied by $Mg_2Si$ to the area of an observation field.

(Recrystallization Ratio)

After samples were collected from 5 sites of each of the plate-like specimens, and the cross sections (bidirectional: in the direction of the grain flow and in the direction perpendicular to the grain flow) thereof were each polished till reaching a specular state, structures were exposed by chemical etching (using caustic soda). The total of 10 cross sections of 2 cross sections at 5 sites were observed using an optical microscope, the recrystallization ratio was calculated by image processing, and an average value in the 10 cross sections was calculated. The recrystallization ratio is a representation of the ratio (%) of an area occupied by the recrystallized region 1 in a cross section of each of the specimens (see FIG. 1).

(Size Distribution Index Value V/r (V: Area Ratio %, and Average Radius nm) of Dispersed Particles)

Samples were collected from 5 sites of each of the plate-like specimens, and the dispersed particles 2 were observed using a TEM (transmission electron microscope of a magnification of ×20000 (see FIG. 2)). The area ratio (V) of the dispersed particles and the average radius (r) thereof were calculated by subjecting five photographs to digital processing. The area ratio (V) was designated as the ratio (%) of the total area of the dispersed particles to the total area of the photographs. The radii (nm) of circles each having the same area were calculated for the individual dispersed particles on a one-by-one basis, and the average value of the radii was used as the average radius (r). The size distribution index value V/r (%/nm) of the dispersed particles was calculated using the values of V and r. The thicknesses of the specimens used for the observation under a TEM were substantially 2000 Å and equal.

TABLE 2

| | | Homogenizing Heat Treatment × 4 h | | | Hot Extrusion | Hot Forging | | Al Alloy Forging | | |
|---|---|---|---|---|---|---|---|---|---|---|
| | Ingot No. | Heat-Up Rate (° C./hr) | Holding Temperature (° C.) | Cooling Rate (° C./hr) | Finishing Temperature (° C.) | Starting Temperature (° C.) | Finishing Temperature (° C.) | Area Ratio (%) of $Mg_2Si$ (%) | Recrystallization Ratio (%) | Dispersed Particles V/r |
| Example 1 | A | 120 | 540 | 120 | — | 510 | 410 | 0.05 | 5 | 0.23 |
| Example 2 | B | 120 | 540 | 120 | — | 495 | 395 | 0.05 | 10 | 0.24 |
| Example 3 | C | 120 | 540 | 120 | — | 510 | 410 | 0.05 | 8 | 0.22 |
| Example 4 | D | 120 | 540 | 120 | — | 520 | 490 | 0.05 | 5 | 0.20 |
| Example 5 | E | 120 | 540 | 120 | — | 510 | 410 | 0.05 | 10 | 0.20 |
| Example 6 | F | 120 | 540 | 120 | — | 520 | 490 | 0.05 | 5 | 0.20 |
| Example 7 | G | 120 | 540 | 120 | — | 510 | 410 | 0.02 | 10 | 0.21 |
| Example 8 | H | 120 | 540 | 120 | — | 510 | 410 | 0.05 | 10 | 0.22 |
| Example 9 | I | 120 | 520 | 120 | — | 510 | 410 | 0.07 | 5 | 0.28 |
| Example 10 | J | 120 | 560 | 120 | — | 500 | 450 | 0.03 | 10 | 0.22 |
| Example 11 | K | 120 | 550 | 1000 | — | 510 | 410 | 0.03 | 6 | 0.24 |
| Example 12 | L | 120 | 550 | 30000 | — | 510 | 410 | 0.01 | 5 | 0.23 |
| Example 13 | M | 800 | 560 | 120 | — | 510 | 410 | 0.03 | 10 | 0.21 |
| Example 14 | N | 40 | 560 | 120 | — | 510 | 410 | 0.08 | 2 | 0.24 |
| Comparative Example 1 | O | 120 | 580 | 120 | — | 510 | 410 | 0.04 | 25 | 0.19 |
| Comparative Example 2 | P | 120 | 480 | 120 | — | 510 | 410 | 0.20 | 2 | 0.25 |
| Comparative Example 3 | Q | 1500 | 560 | 120 | — | 510 | 410 | 0.05 | 35 | 0.17 |
| Comparative Example 4 | R | 20 | 560 | 120 | — | 510 | 410 | 0.19 | 3 | 0.26 |
| Comparative Example 5 | S | 120 | 560 | 90 | — | 510 | 410 | 0.22 | 5 | 0.23 |
| Comparative Example 6 | T | 120 | 540 | 120 | — | 455 | 350 | 0.05 | 95 | 0.15 |
| Comparative Example 7 | U | 120 | 540 | 120 | — | 585 | | Cracking Occurred during Forging | | |
| Comparative Example 8 | V | 120 | 540 | 120 | — | 510 | 410 | 0.05 | 60 | 0.15 |
| Comparative Example 9 | W | 120 | 540 | 120 | — | 540 | 440 | 0.01 | 15 | 0.25 |
| Comparative Example 10 | X | 120 | 540 | 120 | — | 540 | 440 | 0.25 | 10 | 0.26 |
| Comparative Example 11 | Y | 120 | 540 | 120 | — | 510 | 410 | 0.30 | 5 | 0.25 |
| Comparative Example 12 | Z | 120 | 540 | 120 | — | 510 | 410 | 0.20 | 1 | 0.28 |
| Example 15 | Z1 | 120 | 540 | 120 | 500 | 510 | 410 | 0.04 | 4 | 0.21 |
| Comparative Example 13 | Z1 | 120 | 540 | 120 | 320 | 510 | 410 | 0.04 | 21 | 0.21 |
| Comparative Example 14 | Z2 | 120 | 540 | 120 | — | 470 | 395 | 0.50 | 10 | 0.25 |
| Comparative Example 15 | Z3 | 120 | 540 | 120 | — | 470 | 395 | 0.45 | 10 | 0.22 |
| Comparative Example 16 | Z4 | 120 | 540 | 120 | — | 510 | 410 | 0.05 | 25 | 0.30 |
| Comparative Example 17 | Z5 | 120 | 540 | 120 | — | 510 | 410 | 0.05 | 30 | 0.22 |
| Comparative Example 18 | Z6 | 120 | 540 | 120 | — | 470 | 395 | 0.14 | 15 | 0.22 |
| Comparative Example 19 | Z7 | 120 | 540 | 120 | — | 510 | 410 | 0.05 | 5 | 0.35 |
| Comparative Example 20 | Z8 | 120 | 540 | 120 | — | 510 | 410 | 0.05 | 5 | 0.21 |
| Comparative Example 21 | Z9 | 120 | 540 | 120 | — | 510 | 410 | 0.05 | 5 | 0.21 |

(Note)

Plate-like specimens of Examples 1 to 15 and Comparative Examples 1 to 13 (except Comparative Example 7) were each subjected to solution treatment (555° C. × 3 hr), quenching (into warm water at 40° C.), and artificial aging treatment (180° C. × 5 hr) after hot forging.

Next, for each of the plate-like specimens (subjected to the T6 tempering treatment) of Examples 1 to 15, and Comparative Example 1 to 21, strength, corrosion resistance, and toughness were evaluated by the following evaluation method. The result of the evaluation is shown in Table 3. Since forging cracking occurred in Comparative Example 7, evaluation was not performed.

(Strength: Yield Strength)

Twelve test pieces (the longitudinal direction of each of the tensile test pieces was perpendicular to the grain flow) were collected from each of the plate-like specimens, and subjected to a tensile test. The tensile test was performed using a test shape according to the provisions of JIS-Z-2201 by a test method according to the provisions of JIS-Z-2241. The average values of tensile strengths, 0.2% yield strengths, and elongations of the twelve test pieces were designated as the characteristic values of the plate-like specimens. The specimens having 0.2% yield strengths (expressed as Yield Strength in Table 3) of 350 MPa or above were evaluated as having excellent strengths.

(Corrosion Resistance: SCC Resistance)

Twelve test pieces (C-rings) were collected from each of the plate-like specimens, and subjected to a SCC resistance test. The SCC resistance test was performed using a test shape and a test method according to the provisions of JIS-H-8711 (Stress Corrosion Cracking Test-Section 5: Production of C-Ring Test Pieces and Test). Under added stress of 250 MPa and during a test period of 90 days, the test pieces which did not undergo cracking were each provided with "O" representing excellent SCC resistance, and evaluated as having excellent corrosion resistance, while the test pieces which underwent cracking were each provided with "X" representing poor SCC resistance, and evaluated as having poor corrosion resistance.

(Toughness: Impact Value)

Twelve test pieces (the longitudinal direction of each of the impact test pieces was perpendicular to the grain flow) were collected from each of the plate-like specimens, and subjected to the Charpy impact test. The impact test was performed using a test shape according to the provisions of JIS-Z-2202 by a test method according to the provisions of JIS-Z-2242. The average value of the impact values of the twelve test pieces was designated as the characteristic value of the plate-like specimens. The test pieces having impact values of 15 J/cm$^2$ or above were each evaluated as having excellent toughness.

TABLE 3

| | Tensile strength (Mpa) | Yield strength (Mpa) | Elongation (%) | SCC Resistance | Impact value (J/cm$^2$) |
|---|---|---|---|---|---|
| Example 1 | 390 | 365 | 17.0 | ○ | 16.0 |
| Example 2 | 385 | 360 | 14.2 | ○ | 16.0 |
| Example 3 | 395 | 370 | 17.0 | ○ | 17.0 |
| Example 4 | 400 | 375 | 16.0 | ○ | 17.5 |
| Example 5 | 375 | 355 | 25.0 | ○ | 20.0 |
| Example 6 | 385 | 360 | 16.0 | ○ | 22.0 |
| Example 7 | 385 | 360 | 24.0 | ○ | 23.0 |
| Example 8 | 370 | 350 | 18.0 | ○ | 17.0 |
| Example 9 | 400 | 375 | 17.0 | ○ | 18.0 |
| Example 10 | 390 | 370 | 22.0 | ○ | 24.0 |
| Example 11 | 395 | 370 | 18.5 | ○ | 19.0 |
| Example 12 | 405 | 380 | 20.0 | ○ | 22.0 |
| Example 13 | 387 | 365 | 19.0 | ○ | 17.0 |
| Example 14 | 395 | 375 | 16.0 | ○ | 15.5 |
| Comparative Example 1 | 360 | 340 | 19.0 | X | 17.0 |
| Comparative Example 2 | 390 | 365 | 13.0 | ○ | 11.0 |
| Comparative Example 3 | 367 | 345 | 15.0 | X | 16.0 |
| Comparative Example 4 | 386 | 365 | 15.0 | ○ | 14.0 |
| Comparative Example 5 | 370 | 345 | 13.0 | ○ | 12.0 |
| Comparative Example 6 | 375 | 351 | 15.5 | X | 11.5 |
| Comparative Example 7 | Cracking Occurred during Forging | | | | |
| Comparative Example 8 | 385 | 355 | 19.0 | X | 18.0 |
| Comparative Example 9 | 390 | 370 | 14.5 | X | 11.0 |
| Comparative Example 10 | 390 | 360 | 15.0 | X | 12.0 |
| Comparative Example 11 | 360 | 320 | 15.0 | ○ | 11.0 |
| Comparative Example 12 | 415 | 386 | 12.0 | ○ | 10.5 |
| Example 15 | 385 | 360 | 19.0 | ○ | 20.0 |
| Comparative Example 13 | 375 | 340 | 15.0 | X | 14.0 |
| Comparative Example 14 | 410 | 382 | 10.0 | ○ | 8.0 |
| Comparative Example 15 | 390 | 375 | 12.0 | X | 11.0 |
| Comparative Example 16 | 385 | 375 | 7.0 | ○ | 9.0 |
| Comparative Example 17 | 380 | 360 | 8.0 | ○ | 8.0 |
| Comparative Example 18 | 420 | 400 | 15.0 | X | 13.0 |
| Comparative Example 19 | 375 | 365 | 8.0 | ○ | 9.0 |
| Comparative Example 20 | 380 | 365 | 7.0 | ○ | 9.0 |
| Comparative Example 21 | 378 | 363 | 8.0 | ○ | 11.0 |

As is obvious from the result of Table 3, it has been confirmed that each of Examples 1 to 15 satisfying the scope of claims of the present invention is excellent in strength (yield strength), corrosion resistance (SCC resistance), and toughness (impact value).

By contrast, in each of Comparative Examples 1 to 7, and 13 produced under production conditions outside the scope of claims of the present invention, the metal structure (the area ratio of $Mg_2Si$, the recrystallization ratio, and the size distribution index value of the dispersed particles) does not satisfy the scope of claims of the present invention even when the aluminum alloys having the compositions within the scope of claims of the present invention were used. As a result, it has been confirmed that any of the strength (yield strength), corrosion resistance (SCC resistance), and toughness (impact value) thereof is significantly inferior to that in each of Examples. In Comparative Example 7, forging cracking occurred during hot forging.

In addition, each of Comparative Examples 8 to 12, and 14 to 21 using the aluminum alloys having the compositions outside the scope of claims of the present invention was produced under production conditions within the scope of claims of the present invention, but the metal structure (the area ratio of $Mg_2Si$, the recrystallization ratio, and the size distribution index value of the dispersed particles) thereof does not satisfy the scope of claims of the present invention. As a result, it has been confirmed that any of the strength (yield strength), corrosion resistance (SCC resistance), and toughness (impact value) thereof is significantly inferior to that in each of Examples.

The invention claimed is:

1. An aluminum alloy forging comprising an aluminum alloy comprising aluminum and, by mass, Mg: 0.6 to 1.0%, Si: 0.8 to 1.4%, Mn: 0.4 to 1.0%, Fe: 0.05 to 0.35%, Zn: 0.1% or below, Cu: 0.2% or below, Cr: 0.35% or below, Zr: 0.25% or below, Ti: 0.01 to 0.1%, and inevitable impurities, and having a hydrogen gas concentration of 0.25 ml/100 g of Al or below, wherein an area ratio of $Mg_2Si$ having a maximum length of 0.1 μm or above is 0.15% or below, a recrystallization ratio of the aluminum alloy is 20% or below, and a size distribution index value defined by V/r of dispersed particles of the aluminum alloy, wherein V is an area ratio [%] of dispersed particles, and r is an average radius [nm] of the dispersed particles, is 0.20 or above.

2. The aluminum alloy forging according to claim 1, wherein the aluminum alloy comprises, by mass, Mn of higher than 0.6% and equal to less than 1.0%.

3. An aluminum alloy forging obtained by the process comprising:

A) melting the aluminum alloy according to claim 1 into a molten metal;

B) subjecting the molten metal to degassing treatment to adjust the hydrogen gas concentration to 0.25 ml/100 g of Al or below;

C) casting the molten metal subjected to the degassing treatment into an ingot;

D) subjecting the ingot to homogenizing heat treatment in which the ingot is heated up to a holding temperature of 510 to 570° C. at an average heat-up rate more than 20° C./hr and not more than 1000° C./hr, held at the holding temperature for 2 hours or longer, and then cooled such that an average cooling rate during cooling from the holding temperature to at least 350° C. is 110° C./hr or above;

E) with the ingot subjected to the homogenizing heat treatment as a forging raw material, subjecting the forging raw material to hot forging having a starting temperature of 460 to 560° C., and a finishing temperature of 365° C. or above; and F) performing, after the forging E), T6 or T7 tempering treatment comprising solution treatment, quenching, and artificial aging treatment.

4. The aluminum alloy forging according to claim 1, wherein the aluminum alloy comprises, by mass, Mn of from 0.7% to 0.9%.

5. The aluminum alloy forging according to claim 1, wherein the aluminum alloy comprises, B of 300 ppm or below.

6. The aluminum alloy forging according to claim 1, wherein the aluminum alloy comprises, by mass, Mg of from 0.62% to 0.92%.

7. The aluminum alloy forging according to claim 1, wherein the aluminum alloy comprises, by mass, Zn of 0.05% or below.

8. The aluminum alloy forging according to claim 1, wherein the aluminum alloy comprises, by mass, Fe of from 0.08% to 0.30% or below.

9. A process for producing an aluminum alloy forging according to claim 1, the process comprising:

A) melting the aluminum alloy according to claim 1 into a molten metal;

B) subjecting the molten metal to degassing treatment to adjust the hydrogen gas concentration to 0.25 ml/100 g of Al or below;

C) casting the molten metal subjected to the degassing treatment into an ingot;

D) subjecting the ingot to homogenizing heat treatment in which the ingot is heated up to a holding temperature of 510 to 570° C. at an average heat-up rate more than 20° C./hr and not more than 1000° C./hr, held at the holding temperature for 2 hours or longer, and then cooled such that an average cooling rate during cooling from the holding temperature to at least 350° C. is 110° C./hr or above;

E) with the ingot subjected to the homogenizing heat treatment as a forging raw material, subjecting the forging raw material to hot forging having a starting temperature of 460 to 560° C., and a finishing temperature of 365° C. or above; and F) performing, after the forging E), T6 or T7 tempering treatment comprising solution treatment, quenching, and artificial aging treatment.

* * * * *